United States Patent [19]

Dolan et al.

[11] Patent Number: 4,692,967

[45] Date of Patent: Sep. 15, 1987

[54] TEXTILE FIBER DRAFTING APRON AND METHOD

[75] Inventors: John J. Dolan, Blairgowrie; Charles Dye, Dundee, both of Scotland

[73] Assignee: Day International Corporation, Dayton, Ohio

[21] Appl. No.: 381,667

[22] Filed: May 25, 1982

[51] Int. Cl.[4] ..... B29C 25/00

[52] U.S. Cl. ..... 19/244; 264/514

[58] Field of Search ..... 19/244; 264/514; 474/237, 239

[56] References Cited

U.S. PATENT DOCUMENTS

| | | | |
|---|---|---|---|
| 2,226,768 | 12/1940 | Harrison | 264/514 X |
| 2,341,656 | 2/1944 | Rockoff | 19/244 X |
| 2,362,240 | 11/1944 | Bacon | 19/244 |
| 2,912,722 | 11/1959 | Howell | 19/244 |
| 3,011,221 | 12/1961 | Howell | 19/244 |
| 3,900,545 | 8/1975 | Korenwa et al. | 264/514 X |
| 4,012,962 | 3/1977 | Ballou et al. | 474/237 |
| 4,143,559 | 3/1979 | Meadows et al. | 474/91 |
| 4,286,429 | 9/1981 | Lin | 474/239 |
| 4,327,044 | 4/1982 | Dolan et al. | 19/244 X |

OTHER PUBLICATIONS

Bendix Corp. Manual on Profilometer Type Veg Model 22, Manual No. 70467307.

*Primary Examiner*—Louis K. Rimrodt

*Attorney, Agent, or Firm*—Killworth, Gottman, Hagan & Schaeff

[57] ABSTRACT

A textile fiber drafting apron and method of manufacture, wherein the apron is free of cord reinforcement and is formed of a single extruded layer of material. The outer fiber working surface has a smoothness comparable to conventional ground surface, and is expressed in terms of average depth of remaining depressions, as measured on a standard measuring device.

4 Claims, 5 Drawing Figures

TEXTILE FIBER DRAFTING APRON AND METHOD

BACKGROUND OF THE INVENTION

1. Field of the Invention

This invention relates to textile fiber drafting aprons, as well as a method of manufacturing the aprons. Aprons of this type are used in the process known as drafting or texturing, in which bundles of discontinuous natural or synthetic fibers are passed between pairs of nearly contacting aprons which draws them out into long strands. These strands have superior physical characteristics, particularly increased tensile strength, and have uniform properties that enable them to be further used in textile processing.

2. Prior Art Statement

Conventional aprons are formed of two different elastomeric compounds, each formed into a separate layer and laminated together to form the finished product. Normally, the apron must be reinforced with cords located between the laminated layers and extending longitudinally of the circumference of the apron. It has also been known to reinforce aprons with fibrous materials in the two layers, and also to form the apron from a single layer of elastomeric material into which reinforcing fibers have been incorporated.

These prior art concepts are set forth in the following U.S. Patents:

Bacon, U.S. Pat. No. 2,362,340, Nov. 7, 1944
Howell, U.S. Pat. No. 3,011,221, Dec. 5, 1961
Meadows, U.S. Pat. No. 4,143,559, Mar. 13, 1979
Bendix Corporation Manual on Profilometer ® Type VEG Model 22, Manual No. 70467307

The two layer reinforced cord construction is shown in the Howell Patent; the two layer fiber reinforcement in the Bacon patent; and the single layer fiber reinforcement in the Meadows et al patent. It should be noted that in all these prior art patents, the finished product must have a finish grinding operation on the outer surface in order to provide a desirable smooth surface for contacting the fibers being drafted. Thus, none of these patents suggest the concept of a non-reinforced, single layer apron having an unground fiber working surface. The Profilometer ® is used to measure surface roughness as a comparison of the novel apron and standard aprons.

SUMMARY OF THE INVENTION

The present invention features a monolithic drafting apron without reinforcement, being formed of a single layer of elastomeric material, having an outer fiber working surface that has a smoothness without grinding, equivalent to the smoothness of a conventional ground surface.

This invention provides an important contribution to the textile art by eliminating the cost of grinding, while also taking advantage of a single layer concept to avoid the costly step of laminating two layers.

The cord reinforcing concept was based on the assumption that these cords were necessary to stabilize the apron, so that such problems as stretching, distorting or creeping, would not occur during operation. As noted above, later attempts to eliminate the cord reinforcement included the use of fibers. The present invention eliminates either type of reinforcement, at a hugh cost saving and a simplified production procedure.

The conventional surface grinding procedure has always been deemed necessary to achieve close dimensional tolerances, and to provide the smooth working surface that is needed to process the fibers. Applicants have found, however, that grinding can have certain drawbacks, in addition to the cost. Where thin-walled aprons are involved, the grinding process often induces distortion in the surface which could adversely affect the important dimensional tolerances.

The improved apron described and claimed herein provides an important part of the textile fiber process, and the novel method of making this apron is also of great importance.

Other objects, uses and advantages of this invention are apparent from the following description and accompanying drawings wherein:

DESCRIPTION OF THE PREFERRED EMBODIMENTS

Figure 1:
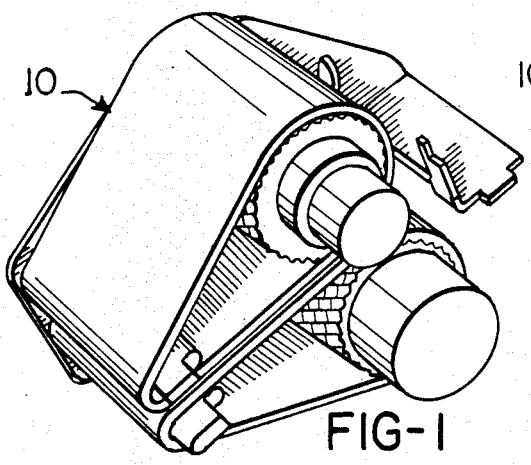
FIG. 1 is a perspective view illustrating a pair of exemplary textile aprons of this invention mounted on associated components comprising a typical double apron system.
Figure 2:
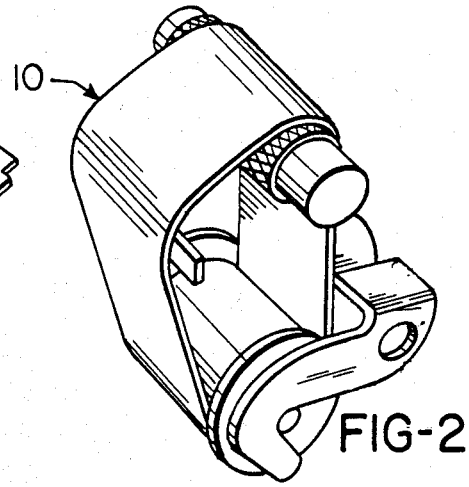
FIG. 2 is a perspective view illustrating a single exemplary textile apron mounted on associated components comprising a single apron system.
Figure 3:
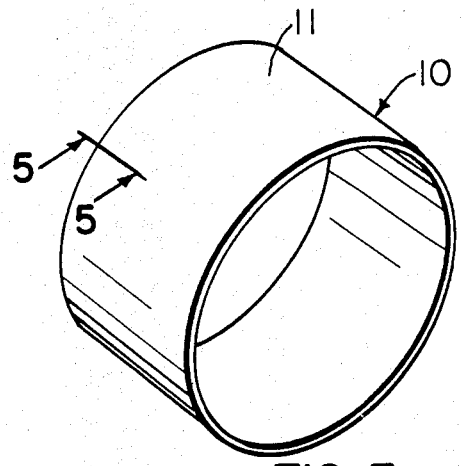
FIG. 3 is a perspective view of the novel apron made in accordance with the present invention.

Reference is now made to FIGS. 1, 2 and 3 of the drawing for presentations of typical texturing or drafting aprons as used in a double apron system (FIG. 1) and as used in single apron systems (FIG. 2). Each of these aprons though of different physical size is of the same construction and for simplicity and ease of presentation, each of these aprons is designated by the same general reference numeral 10.

Figure 5:
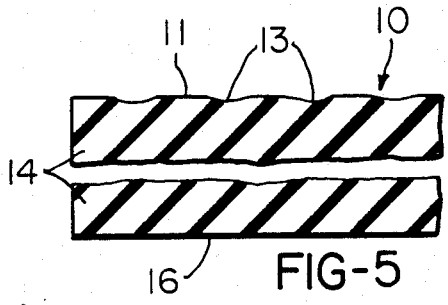
FIG. 5 is a greatly enlarged fragmentary cross-section of the novel apron, taken along lines 5—5 of FIG. 3, illustrating the nature of the material and the smoothness of the outer surface.

The apron 10 is particularly adapted to be operated in an endless path which is parallel to a central longitudinal axis of such apron 10; and, as seen in FIG. 5 the apron 10 comprises a polymeric matrix material 14 which is shown by cross-hatching as being in the form of a rubber compound which may be either a natural rubber compound or a synthetic rubber compound.

Figure 4:
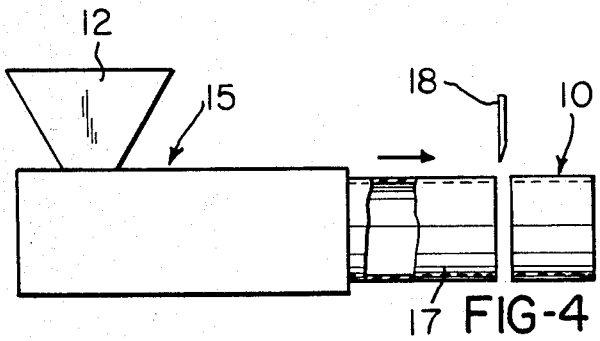
FIG. 4 is a perspective view of a typical extruder for forming the novel apron.

The apron 10 is in the form of a tubular member having an outer surface 11 and an inner surface 16. The apron is flexible, similar to a belt, so that it can be readily stretched over the mechanism shown in FIG. 1 or 2. There are many processes of forming the apron, one of which is illustrated in FIG. 4. An extruder 15 of conventional design is used to extrude the polymeric material which has been placed in hopper 12 to form a monolithic continuous sleeve 17 having a wall of uniform thickness. This sleeve is then severed by a conventional cutting device 18 to form the aprons 10 of desired length. As indicated above, the polymeric material is preferably a natural or synthetic rubber, but may be an appropriate plastic material such as vinyl. The rubber compounds may be any conventional curable rubber, such as acrylonitrile-butadiene, chloraprene, EPDM, Hypalon, or blends thereof.

The aprons may be cured either prior to or after cutting, and are cured by conventional processes known in the industry. For example, the sleeve or aprons may be blown on a mandrel and wrapped with fabric or other wrapping material, placed in a heater at 270° to 300° F. for about 30 minutes, and the wrap removed. The sleeve or aprons are removed from the mandrel and cooled. The finished aprons may have a variety of dimensions; typical aprons may have a nominal diameter of about 1.25 inches to 3.2 inches; a width of about 0.8 inches to 1.5 inches; and a wall thickness of about 0.03 inches to 0.06 inches.

The extruded sleeve achieves a smooth surface by virtue of closely controlled tolerances in the extruder die, and also by selecting a wrapping material during curing that controls such tolerances. Thus, neither the finished sleeve or cut-off apron needs to be ground to provide the useable working surface 11. While microscopic indentations or depressions 13 to remain in the surface 11, they are not of sufficient magnitude to seriously affect the smoothness.

In order to compare the smoothness of surface 11, it was compared with a conventionally manufactured apron that was ground with a carborundum grinding wheel at 1025 RPM. The comparison was made by measuring the surfaces with a machine known as a PROFILOMETER ®, Type VEG, Model 22, manufactured by Bendix Corporation, Automation and Measurement Division, Dayton, Ohio. The manual for this machine is enclosed herewith and referred to above in connection with the prior art. This machine records an arithmetic average roughness height in micro-inches, and this is done according to ANSI Standard B46.1 (R-1971) of the American National Standards Institute. The readings provided the following results:

| | AVERAGE ROUGHNESS |
|---|---|
| STANDARD APRON | 9.8 Micro-inches |
| NOVEL APRON | 10.0 Micro-inches |

These results indicate that the two products are comparable in smoothness (roughness), and that the novel apron has an outer surface that is quite acceptable in the trade.

While the exemplary embodiments of the invention are described above, other forms of the invention may also be utilized within the scope of the appended claims.

We claim:

1. In a textile fiber drafting apron in the form of a flexible sleeve having an outer fiber working surface and an inner work member contacting surface, the improvement wherein said apron is comprised of a single monolithic layer of polymeric material free of reinforcement and wherein said outer surface is smooth and unground and provides an acceptable fiber working surface.

2. The apron of claim 1 wherein said outer surface has an average roughness of about 10 micro-inches in depth.

3. In a method of making a textile fiber drafting apron having an outer fiber working surface and an inner work member contacting surface, the improvement comprising the steps of providing a polymeric material and forming said material into a flexible monolithic sleeve free of reinforcement and wherein said forming step maintains said outer surface smooth without the necessity of grinding, said smooth outer surface providing an acceptable surface for fiber working.

4. The method of claim 3 wherein said forming step comprises extruding said material to form said sleeve.

* * * * *